US008714371B2

(12) United States Patent
Haider

(10) Patent No.: US 8,714,371 B2
(45) Date of Patent: May 6, 2014

(54) DISHWASHER BASKET WITH A CUP SUPPORT

(75) Inventor: Gerhard Haider, Nürnberg (DE)

(73) Assignee: Electrolux Home Products Corporation, N.V., Brussels (BE)

( * ) Notice: Subject to any disclaimer, the term of this patent is extended or adjusted under 35 U.S.C. 154(b) by 270 days.

(21) Appl. No.: 13/131,149

(22) PCT Filed: Nov. 26, 2009

(86) PCT No.: PCT/EP2009/008448
§ 371 (c)(1),
(2), (4) Date: May 25, 2011

(87) PCT Pub. No.: WO2010/060628
PCT Pub. Date: Jun. 3, 2010

(65) Prior Publication Data

US 2011/0233158 A1 Sep. 29, 2011

(30) Foreign Application Priority Data

Nov. 26, 2008 (EP) ..... 08020508

(51) Int. Cl.
*A47G 19/08* (2006.01)

(52) U.S. Cl.
USPC ..... 211/41.4; 211/41.5

(58) Field of Classification Search
USPC ..... 211/41.8, 41.9, 41.5, 41.6, 41.4
See application file for complete search history.

(56) References Cited

U.S. PATENT DOCUMENTS

| | | | | |
|---|---|---|---|---|
| 2,708,037 | A * | 5/1955 | Planeta | 211/41.4 |
| 2,907,470 | A * | 10/1959 | Abresch | 211/41.8 |
| 3,050,073 | A | 8/1962 | McMillan | |
| 3,169,641 | A * | 2/1965 | Chapman | 211/41.4 |
| 3,269,790 | A | 8/1966 | Cushing | |
| 3,612,285 | A | 10/1971 | Mason | |
| 3,709,732 | A | 1/1973 | Thomen | |
| 3,752,322 | A * | 8/1973 | Fiocca et al. | 211/41.8 |
| 4,726,475 | A * | 2/1988 | Ferenzi | 211/41.5 |
| 4,927,033 | A * | 5/1990 | Patera et al. | 211/41.9 |
| 5,480,035 | A * | 1/1996 | Smith | 211/41.8 |
| 5,580,025 | A * | 12/1996 | Cross | 211/41.4 |
| 5,918,749 | A * | 7/1999 | Pille et al. | 211/41.8 |
| 6,021,906 | A * | 2/2000 | Heien | 211/41.4 |
| 6,827,225 | B2 * | 12/2004 | Miilu et al. | 211/41.9 |
| D518,615 | S * | 4/2006 | Yang et al. | D32/55 |
| 7,228,975 | B2 * | 6/2007 | Yang et al. | 211/41.4 |
| 7,458,471 | B2 * | 12/2008 | Crudgington, Jr. | 211/41.9 |
| 7,644,826 | B2 * | 1/2010 | Koch et al. | 211/41.4 |
| 7,766,175 | B2 * | 8/2010 | Jadhav et al. | 211/41.9 |
| 2005/0242046 | A1 * | 11/2005 | Lee | 211/41.9 |
| 2006/0213844 | A1 * | 9/2006 | Purushothaman | 211/41.9 |
| 2007/0039904 | A1 * | 2/2007 | Purushothaman | 211/41.8 |
| 2007/0199584 | A1 | 8/2007 | Koch et al. | |
| 2009/0050585 | A1 * | 2/2009 | Lindgren et al. | 211/70.7 |
| 2009/0090681 | A1 * | 4/2009 | Graute | 211/41.9 |

FOREIGN PATENT DOCUMENTS

| | | | |
|---|---|---|---|
| DE | 30 22 484 | A1 | 1/1982 |
| EP | 1 475 030 | A | 11/2004 |

OTHER PUBLICATIONS

International Search Report from International Application No. PCT/EP2009/008448, filed Nov. 26, 2009.

* cited by examiner

*Primary Examiner* — Jose V Chen
(74) *Attorney, Agent, or Firm* — Alston & Bird LLP

(57) ABSTRACT

Dishwasher basket comprising a cup support, characterized in that said cup support comprises at least one essentially U-shaped hook adapted for supporting a handle of a tableware item that has a handle that is shaped as a closed loop.

14 Claims, 7 Drawing Sheets

DISHWASHER BASKET WITH A CUP SUPPORT

CROSS REFERENCE TO RELATED APPLICATIONS

This application is a national stage application filed under 35 U.S.C. 371 of International Application No. PCT/EP2009/008448, filed Nov. 26, 2009, which claims priority from European Application No. 08020508.1, filed Nov. 26, 2008, each of which is incorporated herein in its entirety.

The present invention relates to a dishwasher basket comprising a cup support.

Dishwashers usually are equipped with one or two dish racks or dishwasher baskets for supporting the articles to be cleaned, wherein such dish racks usually are designed as slideable drawer baskets that can be pulled out of the washing compartment of the dishwasher so as to facilitate loading and unloading. Such dish racks usually are made of wire mesh so as to provide for a large open area for the cleaning liquid to be sprayed onto the articles supported by the dish rack. Alternatively, the dish rack or parts thereof can be made of plastics.

From DE 103 47 765 A1 there is known a dish rack for a domestic dishwasher, wherein the dish rack is designed as a wire mesh basket. In order to provide for more flexibility in arranging articles in the basket, the basket is equipped with height adjustable shelf portions which can be attached to fittings that are provided at different heights at a sidewall of basket.

From DE 10 2005 058 664 A1 there is known a dish rack, the bottom portion of which is made of a wire-mesh and the sidewalls of which are designed as molded plastic parts comprising recesses in which there are arranged a plurality of pivotable fixtures which can be displaced between a first position in which the fixtures are flush with the respective sidewall of the dish rack and a second position in which the fixture projects from the sidewall towards the center of a basket. The fixtures provide for additional space to support lengthy articles to be cleaned, such as larger knifes and the like.

From DE 603 171 40 T2 there is known a dish rack for a dishwasher that is made of wire mesh and wherein there is provided along one of the side walls of the dish rack a tiltable shelf, that can be pivoted from a first position in which the shelf rests against the sidewall of the basket and a second position in which the shelf projects horizontally from the side wall. Here, the rack is a molded plastic part comprising a plurality of differently shaped openings which serve as cutlery holders.

In U.S. Pat. No. 5,480,035 there is shown a wire mesh dishwasher basket comprising height adjustable cup shelves which can be connected with fixtures that are arranged at different heights along a side wall of the basket.

Furthermore, it is known to provide a dishwasher basket with resilient clamps that are attached to a vertical wire portion of the sidewall of the basket, which clamps, together with said vertical wire portion, form a generally U-shaped holder into which an article to be cleaned can be inserted from above.

While the dish racks referred to above provide for certain flexibility of use of the dish rack, there exists a continuous desire in the art to further improve the available systems in terms of their efficiency and flexibility of use. Furthermore, often tableware items that have been cleaned in the dishwasher, such as cups and the like, are still wet upon conclusion of the drying cycle and have to be dried by hand which is inconvenient for the user of the dishwasher.

In view of the above it is an object of the invention to provide for a cup support for a dishwasher basket and preferably for a dishwasher basket comprising a cup support which provides for additional space to arrange articles within the dish rack or dishwasher basket and which particularly provides for good cleaning and drying results.

In order to solve this problem the present invention provides for a cup support for a dishwasher basket comprising:

(A) a plurality of hooks for supporting handles of tableware items, and (B) an elongate support member that is located at a lower elevation than said hooks for supporting the bodies of tableware items suspending from said hooks.

Whereas the invention provides for the cup support specified above, preferably, the invention solves the same problem in a first preferred embodiment by providing in addition a dishwasher basket comprising a cup support, characterized in that said cup support comprises at least one essentially U-shaped hook adapted for supporting a handle of a tableware item that has a handle that is shaped as a closed loop.

With advantage, the cup support of the invention can comprise a plurality of essentially U-shaped hooks.

The terms dish rack and dishwasher basket are used interchangeably herein. Also the terms washload items and tableware items are used interchangeably herein.

The terms "essentially U-shaped hook" and "handle that is shaped as a closed loop" are intended to be understood as being adapted to interact with each other. A typical example of such interaction is that of a U-shaped hook, for example a piece of bent steel wire, that is suitably connected to a side wall of a dishwasher basket, preferably a side wall that has a mesh structure formed of steel wires, wherein the essentially U-shaped hook has an overall U-shaped shape that is open and is accessible from the top and can take up a closed loop-shaped handle of a wash load item, preferably such as typical for a coffee or tee cup, in order to hold said cup that hangs with its loop-shaped handle from said hook. It is not necessary that the handle of the washload item is a perfectly closed loop as long as the handle can securely interact with the essentially U-shaped hook of the cup support of the invention. Preferably, the "U-shaped hook" has a size and an orientation with respect to a side wall of the dishwasher basket that are adapted to both, ready access of a loop-formed handle into the U-shaped hook from the open top thereof, and a space-saving arrangement of the U-shaped hook and the tableware item hanging from it inside the dishwasher basket. Still preferably, the U-shaped hook has a size and an orientation with respect to a side wall of the dishwasher basket that is such that a washload item hanging from it will with a lower portion thereof rest against at least another component of the dishwasher basket, in particular against said sidewall thereof or against a bottom section of the dishwasher basket, or against another component of the cup support, in particular against the support member disclosed herein.

The "handle that is shaped as a closed loop" is not restricted to a handle in the form of a closed circular loop in the strict meaning thereof but can have any shape of a handle that can duly interact with the essentially U-shaped hook of the cup support of the invention in order to take up and securely support the hanging washload item during a washing cycle of a dishwasher.

The term "elongate support member" as used herein below designates a support member having only a small lateral extension. Thus, the elongate support member can be formed, for example, by a wire member or by an edge of for example a shelf portion.

In contrast to conventional dishwashers, wherein any cup like tableware items are supported on shelf structures in which the amount of open area inherently is limited so that, particularly in the case of plastic shelves, a relatively large portion of the overall shelf area is occupied by the material of which the shelf is made, which thus not only prevents water jets from impinging onto any articles that are located on such shelf, but which also reduces the drying efficiency because the shelf material prevents cleaning liquid from dripping off from the articles placed on the shelf, in accordance with the present invention any tableware items that are equipped with a handle, such as cups, mugs, beakers, cans and the like can be hooked upside down into the U-shaped hooks so as to be securely supported while hanging from said U-shaped hooks during a washing cycle of a dishwasher.

Preferred embodiments of the present invention are defined in the depended claims.

In a second preferred embodiment of the invention, said washload or tableware items rest with their rim on the elongated support member that is located at a lower elevation than the U-shaped hooks. Since the elongate support member has only a small lateral extension, the tableware item that is U-shaped hooked into such a U-shaped hook rests on the elongate support member at only two points along its rim, so that on the one hand there is little obstacle for any water jets that are directed onto the tableware item during a cleaning cycle, and on the other hand, due to the few contact points, the drying of the tableware item is facilitated.

Preferably, the support member comprises a wire loop, and particularly a wire loop comprising an elongate support portion and two side portions by which the support portion is connected to the basket. In embodiments wherein the support member comprises a wire loop, the support member occupies only very little space and hence provides for a particularly large open area for water jets to reach the tableware items and for little contact points that may hinder water from dripping off from the tableware item, which thus enhances both the cleaning and the drying efficiency.

In preferred embodiments, the support member is designed to be pivotal between an inoperative position in which said support member extends in close proximity to a wall portion of said basket and an operative position in which said support member extends at a distance to said wall portion. In this manner the support member can be stowed away to make room for other tableware items, for the event that during a certain washing cycle no cups or the like shall be supported at the U-shaped hooks.

While said plurality of U-shaped hooks and/or said support member can be part of a dishwasher basket and hence can be permanently fixed or pivotally connected to the basket, further flexibility in use of the cup support can be gained if at least one of said plurality of U-shaped hooks and/or said support member is a separate component that can be permanently or removably attached to said dishwasher basket.

In further embodiments of the present invention said plurality of U-shaped hooks and said support member are designed to be part of an accessory assembly that can be permanently or removably attached to said dishwasher basket, in which manner installation of the cup support in a dishwasher basket is facilitated.

The above problem further is solved in that the present invention provides a dish rack for a dishwasher, comprising a basket having a bottom wall portion and side wall portions and a cup support as it is defined in any one of claims 1 to 7.

While as mentioned above, the support member can comprise a wire loop, alternatively the support member can be an edge of a cup shelf that is attached to the particular side portion equipped with the U-shaped hooks. Such cup shelf could be a wire mesh shelf or a shelf made of plastic. Furthermore, such cup shelf edge can be either the edge of the tableware support area of the shelf, or can be an additional elongate member that is provided at a distance of the tableware support area of the shelf, such as a wire portion extending parallel to the tableware support area of the shelf.

In embodiments in which the support member comprises a wire loop, such wire loop can either be connected to the bottom portion of the basket or to the side portion of the basket at which the U-shaped hooks are provided.

In embodiments in which the support member is a wire loop that is connected to the side portion of the basket, there further can be provided a pivotable cup shelf connected to such side wall portion of the basket, which cup shelf is moveable between a first position in which the cup shelf rests against the side wall portion and a second position in which the cup shelf rests on the support member. In this manner the support member can serve the double purpose of on the on hand acting as a rest for any tableware items that are U-shaped hooked onto the U-shaped hooks at the side wall portion, and on the other hand of providing simultaneously or alternatively for a support member for the pivotable cup shelf.

In embodiments in which the support member comprises a wire loop, the wire loop further can be designed as a closed loop comprising said elongated support portion that has the two wire loop side portions and a serpentine shelf portion that is connected to the two wire loop side portions, so as to form a shelf which integrally comprises the elongate support member.

In order to provide for further flexibility in using the dish rack, the U-shaped hooks can be connected in a pivotable manner to the side wall portion of the basket, so as to be moveable between a first position in which the U-shaped hooks rest against the basket and a second position in which the U-shaped hooks project towards the interior of the basket. In such a embodiment, the U-shaped hooks can be stowed away to thus make more room for accommodating on the dish rack for example larger items which are not to be supported by said U-shaped hooks and the support member.

In embodiments wherein the basket comprises a wire mesh structure said U-shaped hooks and/or said support member can comprise an integral component of said wire mesh structure. While such a design provides for less flexibility in using the dish rack, because it is not possible to disassemble the components of the cup support which form an integral part of the wire mesh structure of the basket, it on the other hand provides for a reliable and inexpensive design.

Preferred embodiments of the present invention are described by reference to the drawings in which.

Figure 8:
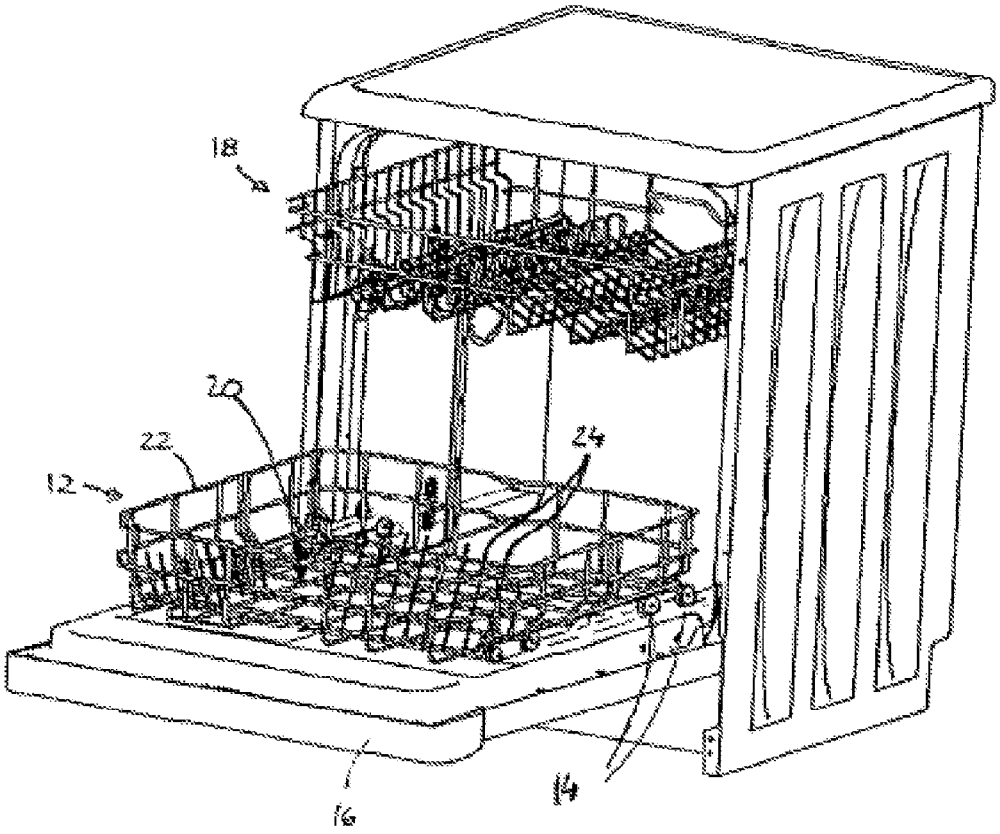
FIG. 8 is a perspective view of a dishwasher being equipped with two dish racks which can be designed as shown in FIGS. 2 to 7.

A dishwasher, such as the domestic dishwasher shown in FIG. 8, typically is equipped with an upper end a lower dish rack to support various tableware items to be washed. Preferably the dish racks are designed as rigid wire baskets. To facilitate loading and unloading of the baskets, the baskets can be moved in a drawer like manner into and out of the washing compartment of the dishwasher. To this end the lower dish rack can be equipped with rollers 14 so as to move along a support rail within the washing compartment as well as on the upper (inner) side of the opened dishwasher door 16. Also the upper dish rack 18 can be pulled out in a drawer like manner such as by providing for lateral drawer runners. As shown in FIG. 8, the dish racks preferably are designed as wire baskets comprising a bottom wall portion 20 and side wall portions 22. The dishwasher racks are provided with a plurality of holding bars 24 that are arranged to support articles to be cleaned.

Figure 1:
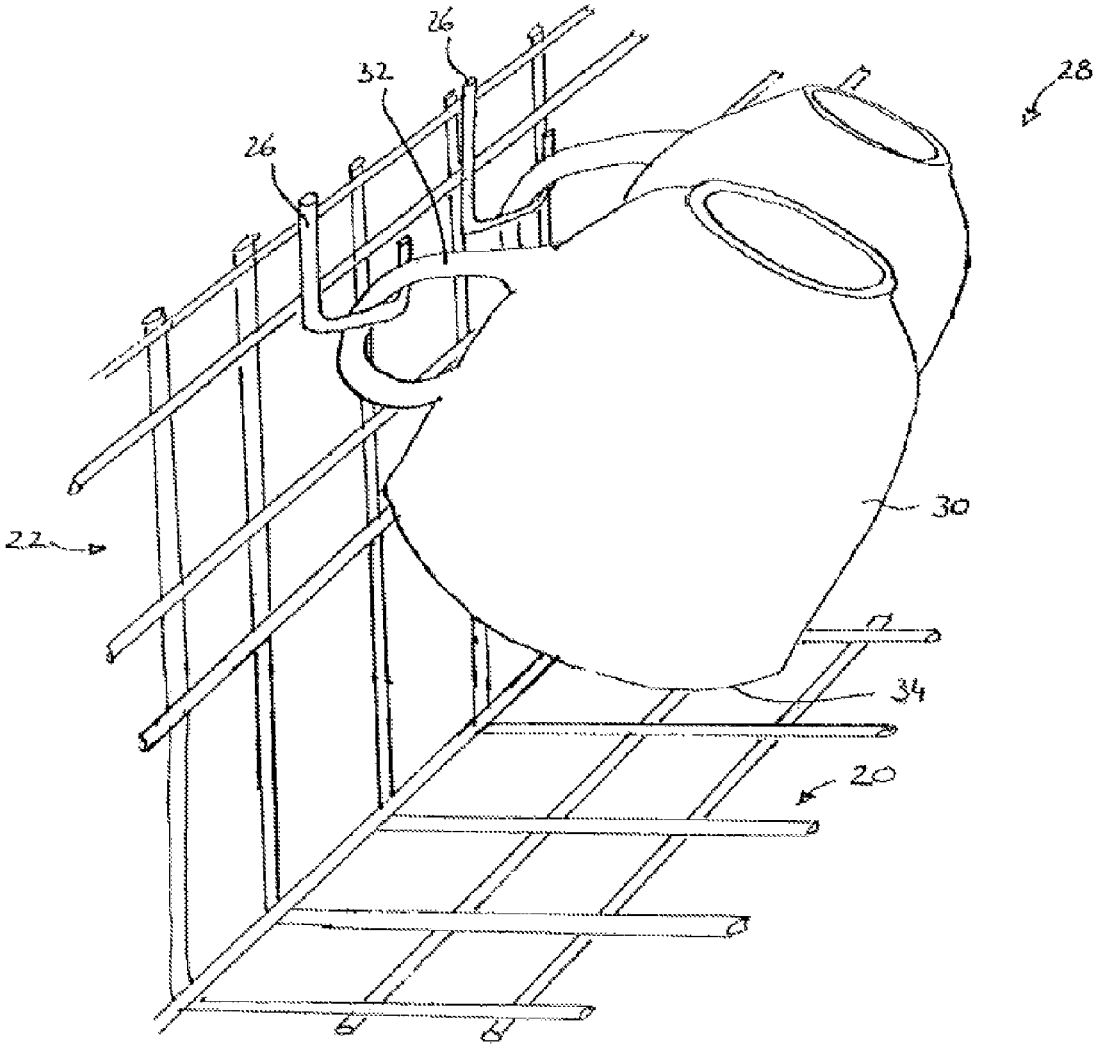
FIG. 1 is a schematic view of a dishwasher basket according to the first preferred embodiment of the present invention.

FIG. 1 that refers to the first preferred embodiment of the invention is an enlarged view of a dish rack or dishwasher basket such as upper dish rack 18 of the dishwasher shown in FIG. 8, wherein one of the side wall portions 22 is provided with at least one or—as shown in FIG. 1—with two, or advantageously with a plurality of U-shaped hooks 26 which serve for supporting tableware items that are equipped with a handle 32 that is shaped as a closed loop, such as cups, mugs, beakers, cans and the like. Thus, a cup 30 can be hooked upside down with its loop-shaped handle 32 being hooked onto one of the dish rack's U-shaped hooks 26, so as to hang down from said hook. In the first embodiment of the invention, the tableware can in principle hang freely down from the U-shaped hook within the dishwasher basket. Since its opening is directed essentially downwards, a washing liquid that is supplied under pressure from a spray nozzle that is arranged below the dishwasher basket, in particular from a rotary spray arm with a plurality of upwardly directed spraying nozzles, can readily enter from below into and efficiently clean the cavity of the tableware item that has been arranged upside down.

However, as is shown for example in FIG. 1 the washload item can rest with its outer sidewall against a sidewall portion 22 of the dishwasher basket that carries the U-shaped hook or the U-shaped hooks in a lower part of the side wall portion 22 of the dishwasher basket as compared to the upper part of said dishwasher basket sidewall portion 22 that carries said U-shaped hook or hooks. That arrangement allows to save further space inside the dishwasher basket. In addition, the opening of the upside-down hung tableware can thus be directed more versus the center of the dishwasher, further enhancing the efficiency with which pressurized cleaning liquid can enter into it. In alternative or in addition to the resting of the tableware against the basket sidewall portion 22 as shown in FIG. 1, the tableware can rest with its lower end—in its upside-down hung orientation on the U-shaped hook—against a bottom wall portion 22 of the bottom mesh of the dishwasher basket, in particular against a bottom wall portion that is higher than another portion of the bottom mesh.

Figure 2:
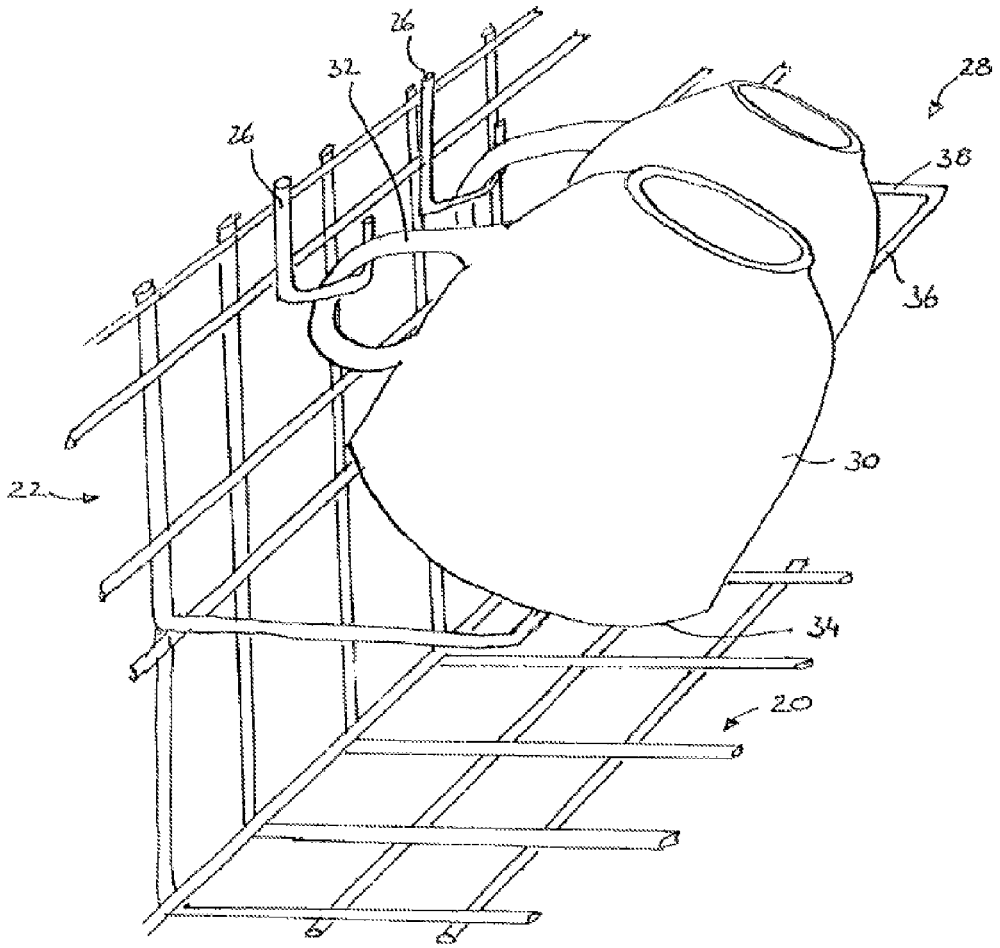
FIG. 2 is a schematic view of a dish rack that is designed in accordance which teachings of the second preferred embodiment present invention.

FIG. 2 that refers to the second preferred embodiment of the invention is an enlarged view of a dish rack such as upper dish rack 18 of the dishwasher shown in FIG. 8, wherein one of the side wall portions 22 is provided with at least one or—as shown in FIG. 2—with two, or advantageously with a plurality of U-shaped hooks 26 as well as an elongate support member 28 which serves for supporting tableware items that are equipped with a handle that is shaped as a closed loop, such as cups, mugs, beakers, cans and the like. Thus, a cup 30 can be hooked upside down with its closed loop-shaped handle 32 hooked onto one of the dish rack U-shaped hooks 26, so as to rest with its rim 34 on elongate support member 28 which in the embodiment shown in FIG. 2 is designed as a wire loop comprising elongate support portion 36 which extends in parallel to the side wall portion 22 of the basket, as well as to shorter side portions 38 by which elongate support portion 36 is connected to side wall 22 of the basket. In another embodiment, the support member 28 is connected to the bottom wall portion 20.

Figure 3:
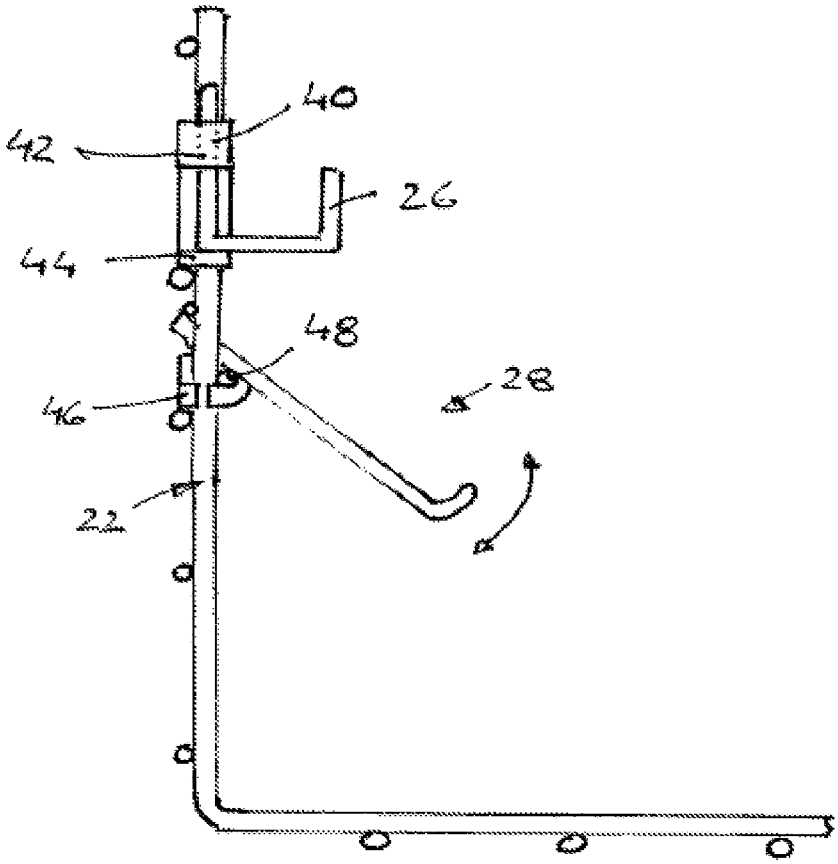
FIG. 3 is a schematic view of a modified embodiment of the dish rack shown in FIG. 2.

In FIG. 3 there is shown a modified embodiment of the arrangement of the second preferred embodiment of the invention shown in FIG. 2, wherein a U-shaped hook 26 is pivotable supported in a bearing element 40 which may be designed as a plastic part that is connected to side wall portion 22 of the basket and which comprises a vertical bore 42 for rotatably accommodating U-shaped hook 26 as well as a support projection 44 on which U-shaped hook 26 rests with its bottom side. In this embodiment the support member 28 is designed as a wire loop that is attached to side wall portion 22 of the basket so as to be arranged at an angle to the side wall. Support member 28 likewise can be designed so as to be pivotable between a first position in which support member 28 rests against side wall portion 22 and a second position in which the elongate support portion 38 extends at a distance to the side wall portion 22 as it is shown in FIG. 3. To this end, support member 28 can be supported by a bearing element 46 which can be a plastic part that, similarly as bearing element 40, is fixedly connected or clamped onto sidewall portion 22 of the basket and which provides for rotational support for a horizontal axis 48 of support member 28.

Figure 4A:
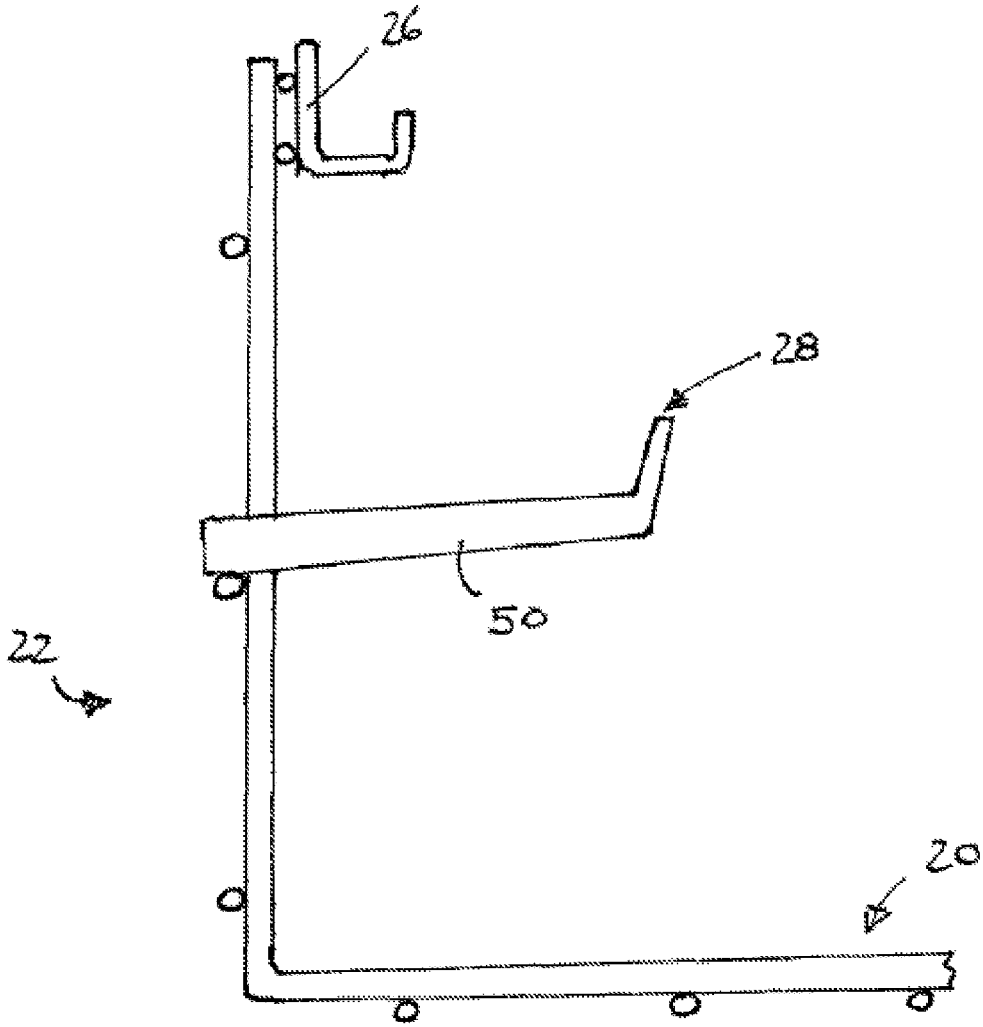
FIGS. 4A and 4B are views similar to that of FIG. 3, each illustrating a further modified embodiment.
Figure 4B:
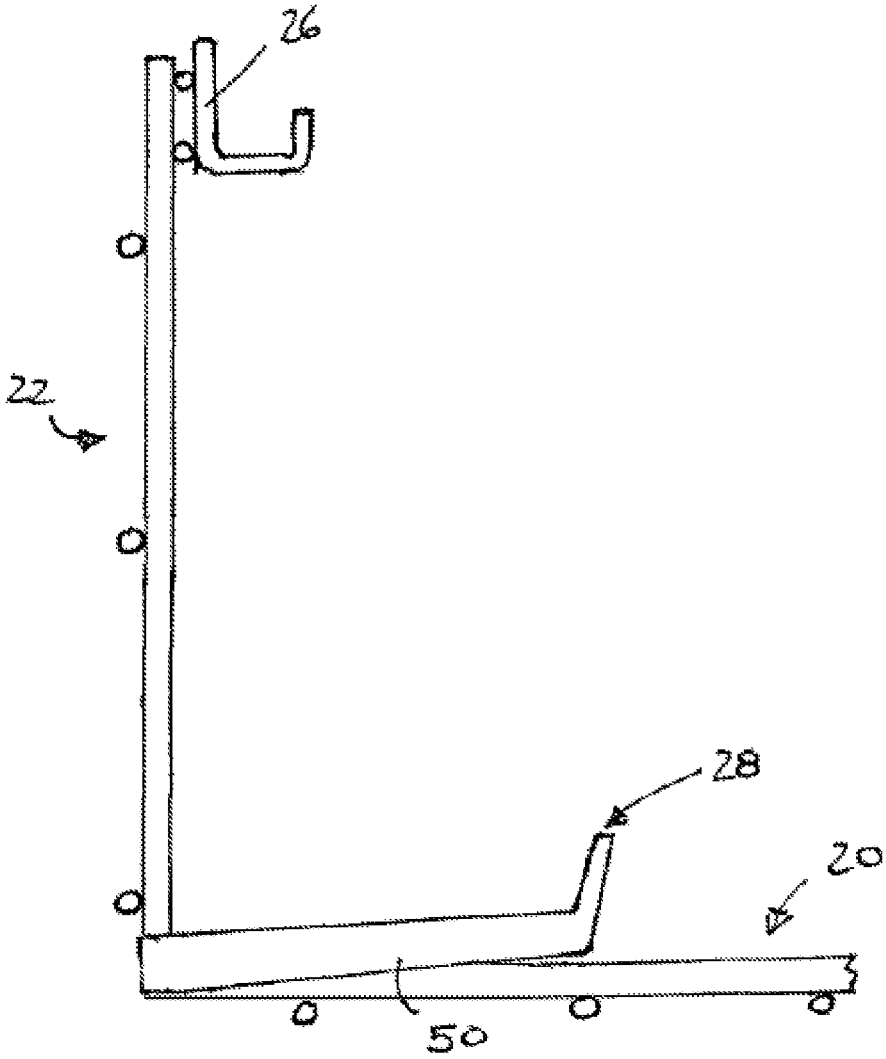

In FIG. 4A there is shown an embodiment in which the elongate support member 28 is part of a cup shelf 50 which is attached to sidewall portion 22 of the basket. While FIG. 4A shows an embodiment wherein shelf 50 is a molded plastic part of which support member 28 comprises an integral part, support member 28 likewise could be an individual member that is attached to shelf 50. Furthermore, while FIG. 4A shows an embodiment in which support member 28 is provided at a higher elevation than the main surface of shelf 50 on which tableware items can be placed, support member 28 also could extend at the same elevation. FIG. 4B shows an embodiment similar to FIG. 4A, but where the support member 28 is attached to a bottom wall portion 20 of the basket.

Figure 5:
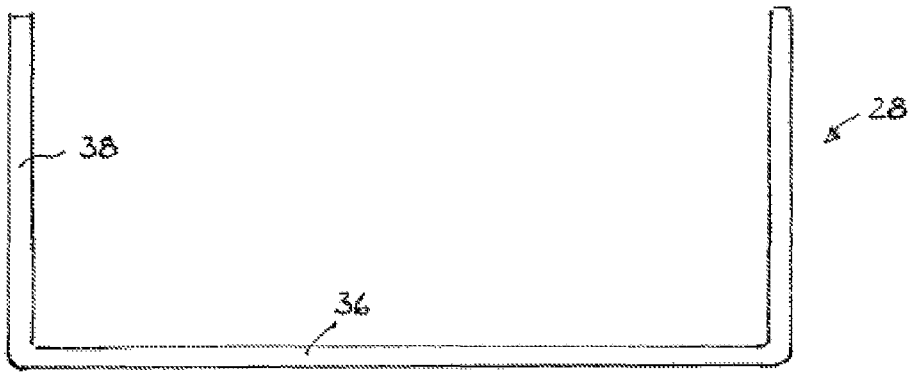
FIG. 5 is a top view of an embodiment of the dish rack of FIG. 2 in which the support member is a wire loop.
Figure 6:
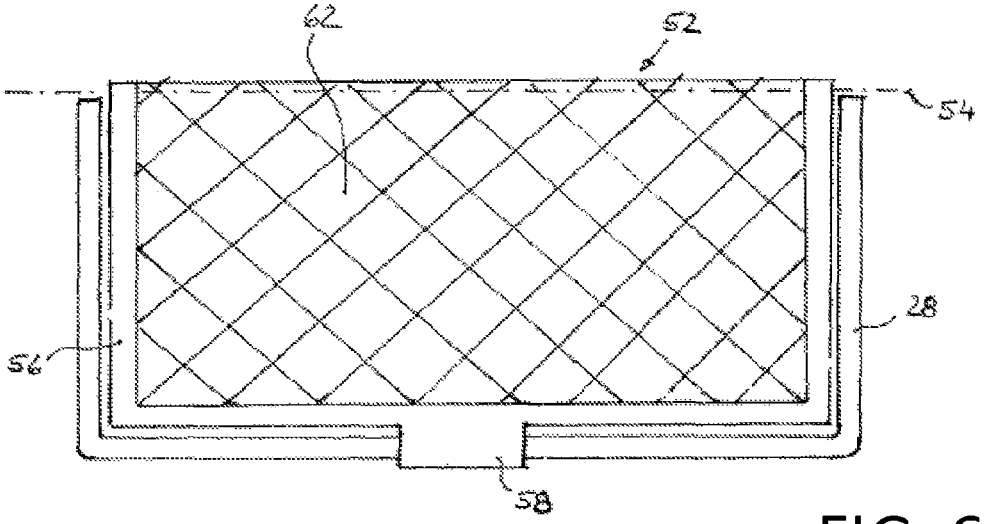
FIG. 6 is a view similar to that of FIG. 5 wherein there is further provided for a pivotable cup shelf.
Figure 7:
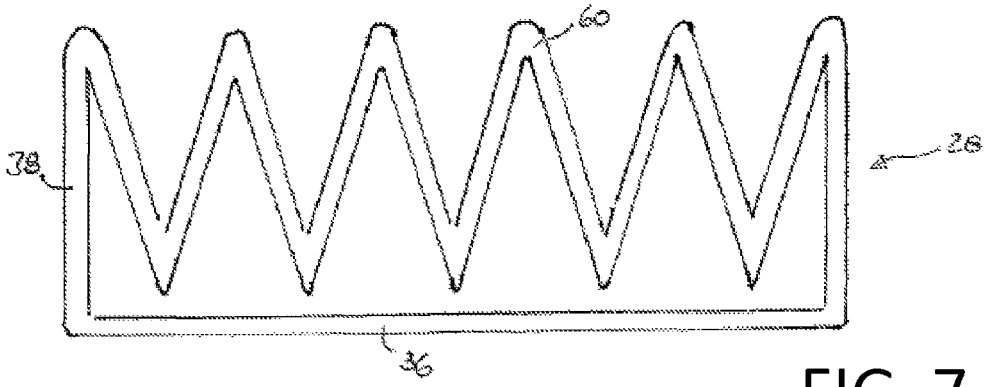
FIG. 7 is a view similar to that of FIG. 5, wherein the wire loop is designed as a closed loop.

FIGS. 5 to 7 show different embodiments of a support member 28 which is designed as a wire loop.

Whereas FIG. 5 is an embodiment similar to that shown in FIG. 2 in which support member 28 comprises an elongate support portion 36 as well as to shorter side portions 38, FIG. 6 shows a similar support member 28 in combination with a shelf member 52 that is arranged within the contour of support member 28. In the embodiment shown in FIG. 6 shelf member 52 is pivotable about an axis 54. Shelf member 52 comprises an outer frame portion 56 having a shape that is similar to that of support member 28, i.e. a longer central portion and two shorter side portions. Within frame portion 56 of shelf member 52 there is provided an open space support region 62 through which cleaning liquid can be sprayed onto any articles that are placed on shelf member 52.

The central portion of frame portion 56 is provided with a tab on which shelf member 52 rests on support member 28 when being pivoted into its position of use. If no tableware items are to be placed onto shelf member 52, the shelf member can be pivoted about axis 54 upwardly so that it rests against the sidewall portion 22 of the basket to thus make room for placing, for example, higher items such as glasses and the like into the region of the basket that is surrounded by support member 28.

FIG. 7 shows an embodiment wherein the support member 28 is designed as a closed wire loop comprising a serpentine shelf portion 60 which is connected between the side portions 38 of the support member 28. Again, the support member 28 can be arranged either fixedly or pivotally at the side wall portion 22 of the dish rack.

List of reference signs

| | | | |
|---|---|---|---|
| 12 | lower dish rack | 40 | bearing element |
| 14 | rollers | 42 | vertical bore |
| 16 | dishwasher door | 44 | support projection |
| 18 | upper dish rack | 46 | bearing element |
| 20 | bottom wall portion | 48 | horizontal axis 48of |
| 22 | side wall portions | 28 | |
| 24 | holding bars | 50 | cup shelf |
| 26 | U-shaped hooks | 52 | shelf member |
| 28 | elongate support member | 54 | axis of 52 |
| 30 | cup | 56 | frame of 52 |
| 32 | loop-shaped handle of | 58 | tab |
| 30 | | 60 | serpentine shelf |
| 34 | rim of 30 | | portion |
| 36 | support portion of 28 | 62 | open space support |
| 38 | side portion of 28 | | region |

The invention claimed is:

1. Dishwasher basket comprising a cup support, wherein said cup support comprises:

at least one essentially U-shaped hook, wherein the U-shaped hook is positioned on the side wall portion of the dishwasher basket such that when the U-shaped hook receives a handle of a tableware item the tableware item hangs from the U-shaped hook; and at least one elongate support member located at a lower elevation than the at least one U-shaped hook, wherein when the tableware item hangs from said U-shaped hook the tableware item rests upon the elongate support member.

2. Dishwasher basket according to claim 1, wherein the cup support comprises a plurality of essentially U-shaped hooks.

3. The dishwasher basket according to claim 1, wherein said support member comprises a wire loop.

4. The dishwasher basket according to claim 1, wherein said support member is designed to be pivotal between an inoperative position in which said support member extends in close proximity to a wall portion of said basket and an operative position in which said support member extends at a distance to said wall portion.

5. The dishwasher basket according to claim 1, wherein said at least one U-shaped hook and/or said support member is a separate component that can be permanently or removably attached to said dishwasher basket.

6. The dishwasher basket according to claim 5, wherein said at least one U-shaped hook and said support member are part of an accessory assembly that can be permanently or removably attached to said dishwasher basket.

7. The dishwasher basket according to claim 1, wherein the dishwasher basket comprises a bottom wall portion and side wall portions.

8. The dishwasher basket according to claim 7, wherein said support member is connected to the bottom wall portion of said basket.

9. The dishwasher basket according to claim 7, wherein said support member is connected to said one of said side wall portions of said basket.

10. The dishwasher basket according to claim 9, wherein said support member comprises a wire loop, said dishwasher basket further comprising a pivotable cup shelf connected to said side wall portion of the basket so as to be movable between a first position in which said cup shelf rests against said side wall portion and a second position in which said cup shelf rests on said support member.

11. The dishwasher basket according to claim 7, wherein said support member comprises a wire loop which is designed as a closed loop comprising said elongated support portion that has two side portions and a serpentine shelf portion that is connected to both side portions of said wire loop.

12. The dishwasher basket according to claim 7, wherein said at least one U-shaped hook is pivotally connected to said side wall portion of the basket so as to be movable between a first position in which said U-shaped hook rests against said side wall portion of the basket and a second position in which said U-shaped hook projects towards the interior of the basket.

13. The dishwasher basket according to claim 7, wherein said basket comprises a wire mesh structure, and wherein said at least one U-shaped hook and/or said support member comprises an integral component of said wire mesh structure.

14. The dishwasher basket according to claim 1, wherein the dishwasher basket comprises a bottom wall portion and side wall portions, wherein said support member is an edge of a cup shelf attached to said wall side portion.

* * * * *